US009275782B2

(12) United States Patent
Gerovac

(10) Patent No.: US 9,275,782 B2
(45) Date of Patent: Mar. 1, 2016

(54) DUAL STROKE MECHANICALLY LATCHED MECHANISM

(75) Inventor: Joseph P. Gerovac, Menomonee Falls, WI (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/238,646

(22) PCT Filed: Aug. 17, 2011

(86) PCT No.: PCT/US2011/048130

§ 371 (c)(1),
(2), (4) Date: Apr. 16, 2014

(87) PCT Pub. No.: WO2013/025213

PCT Pub. Date: Feb. 21, 2013

(65) Prior Publication Data

US 2014/0240066 A1 Aug. 28, 2014

(51) Int. Cl.

| | |
|---|---|
| ***H01H 9/20*** | (2006.01) |
| ***H01F 7/124*** | (2006.01) |
| ***H01H 3/56*** | (2006.01) |
| ***H01H 3/42*** | (2006.01) |

(52) U.S. Cl.

CPC ..... *H01F 7/124* (2013.01); *H01H 3/42* (2013.01); *H01H 3/56* (2013.01)

(58) Field of Classification Search

CPC ..... H01F 7/124
USPC ..... 335/167, 170, 209, 220–229
See application file for complete search history.

(56) References Cited

U.S. PATENT DOCUMENTS

| | | | | |
|---|---|---|---|---|
| 3,750,643 | A | 8/1973 | Fowler et al. | |
| 4,013,312 | A | 3/1977 | DeWeese | |
| 4,142,167 | A | 2/1979 | Little et al. | |
| 5,268,662 | A * | 12/1993 | Uetsuhara | H01F 7/1615 335/229 |
| 6,392,903 | B2 | 5/2002 | Mori et al. | |
| 7,843,293 | B1 * | 11/2010 | Bonjean | H01H 3/28 218/154 |
| 2009/0314620 | A1 | 12/2009 | Lee | |

FOREIGN PATENT DOCUMENTS

DE 10 2005 013231 9/2006

OTHER PUBLICATIONS

International Search Report for PCT/US2011/048130 dated Dec. 16, 2011.
Extended European Search Report, dated Jun. 17, 2015, in corresponding European Patent Application No. 111870898.1.

* cited by examiner

*Primary Examiner* — Bernard Rojas
(74) *Attorney, Agent, or Firm* — Dickinson Wrignt PLLC

(57) ABSTRACT

A switch for an electrical circuit includes a base, a rotatable cam having a first profile and a second profile, a solenoid, a link, and a member comprising a cam follower configured to follow the second profile. A first cycle of the solenoid includes a first energized state and a first de-energized state and the second cycle of the solenoid includes a second energized state and a second de-energized state. A first portion of the link couples to the solenoid, and a second portion of the link movably couples to the first profile of the cam. When the solenoid is in a first cycle, the member moves from a retracted position to an extended position, and when the solenoid is in a second cycle, the member moves from the extended position to the retracted position.

21 Claims, 9 Drawing Sheets

DUAL STROKE MECHANICALLY LATCHED MECHANISM

BACKGROUND

The present disclosure relates generally to the field of latching mechanisms. More specifically, the present disclosure relates to the field of solenoid actuated electromechanical switches.

In the field of capacitor switches (e.g., vacuum interrupter based voltage switches) an operating rod is used to separate electrical contacts and bring the electrical contacts together. Conventional switches use magnetic actuators to move the operating rod to separate electrical contacts and bring the electrical contacts together. Magnetic actuators use rare Earth magnets to hold the operating rod at the end of each stroke, are costly, and require sophisticated controls. Other conventional switches use motor operated spring loaded mechanisms to move the operating rod to separate electrical contacts and bring the electrical contacts together. Motor operated spring loaded mechanisms are complex, costly, and have limited speeds. Other switches have used solenoid actuated mechanisms to move the operating rod that either require one solenoid for each direction of travel or require electronic controls to maintain current at the end of each stroke. These requirements increase reliability concerns and cost.

There is a need for an improved latching mechanism. Thus, there is also a need for a switch that includes a lower cost mechanism for moving the operating rod. Further still, there is a need for a system for and method of moving an operating rod that does not require one solenoid for each direction of travel or require electronic controls to maintain current at the end of each stroke. Yet further, there is a need for an actuator that does not require rare Earth magnets.

SUMMARY

One embodiment of the disclosure relates to a switch for an electrical circuit. The switch includes a base, a cam rotatably coupled to the base and defining a first profile and a second profile, a solenoid comprising alternating first and second cycles, a link including a first portion and a second portion, and a member configured to move between an extended position and a retracted position and comprising a cam follower configured to follow the second profile. The first profile of the cam includes a first position, a second position, a third position, and a fourth position. The first cycle of the solenoid includes a first energized state and a first de-energized state and the second cycle of the solenoid includes a second energized state and a second de-energized state. The first portion of the link couples to the solenoid, and the second portion of the link movably couples to the first profile of the cam. When the solenoid is in the first cycle, the member moves from the retracted position to the extended position, and when the solenoid is in the second cycle, the member moves from the extend position to the retracted position.

Another embodiment relates to a switch for an electrical circuit. The switch includes a solenoid having alternating energized and de-energized states, a cam defining a first profile and a second profile, a link having a first portion and a second portion, and a member configured to move between an extended position and a retracted position and comprising a cam follower configured to follow the second profile. The first portion of the link couples to the solenoid, and the second portion of the link movably couples to the first profile. The cam is configured such that alternating energized states of the solenoid cause opposite linear motion of the member.

Another embodiment relates to a latching system. The latching system includes a solenoid having a first energized state and a second energized state, a member configured to translate between an extended position and a retracted position, and a mechanical linkage operatively coupling the solenoid to the member, the mechanical linkage having a first orientation and a second orientation. The mechanical linkage is configured such that when the solenoid is in the first energized state, the member moves from the retracted position to the extended position and the mechanical linkage moves from the first orientation to the second orientation. The mechanical linkage is further configured such that when the solenoid is in the second energized state, the member moves from the extended position to the retracted position and the mechanical linkage moves from the second orientation to the first orientation.

Another embodiment relates to a switch. The switch includes an operating rod having a first position and a second position, and a solenoid actuator for moving the operating rod from the first position to the second position and from the second position to the first position. The solenoid actuator includes only one solenoid for causing travel in each direction between the first position and the second position and does not require electronic controls to maintain current at the first position and the second position.

DETAILED DESCRIPTION

Figure 1:
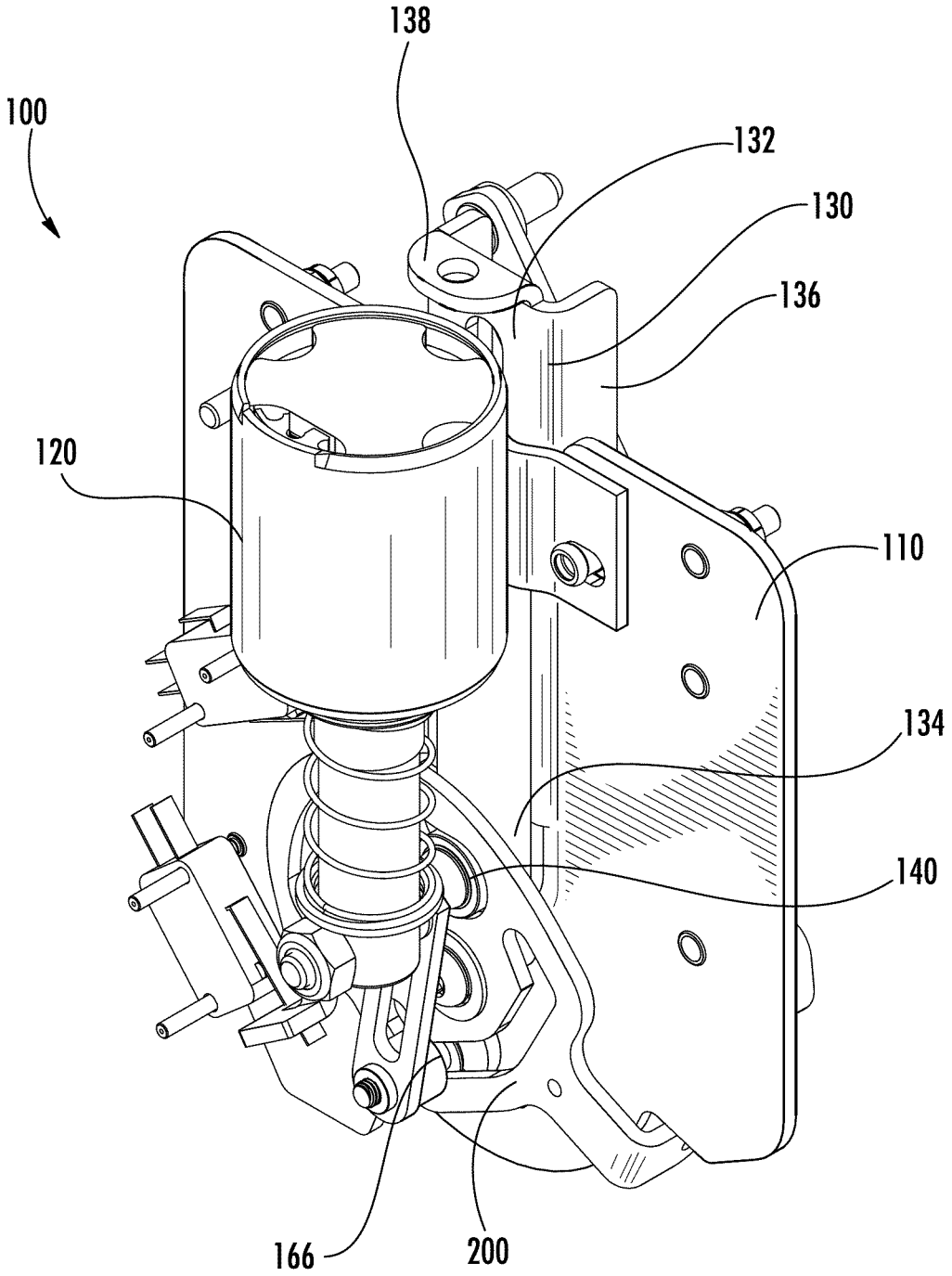
FIG. 1 is a perspective view of a latching mechanism, shown according to an exemplary embodiment.

Referring generally to the FIGURES, a latching mechanism and components thereof are shown according to an exemplary embodiment. The latching mechanism generally includes a solenoid, an operating rod, and a mechanical linkage (shown to include a cam) coupling the solenoid to the operating rod. Actuation of the mechanical linkage causes the operating rod to move between a retracted position and an extended position. Further, the linkage provides a toggle action. That is, each time the solenoid is actuated, it provides the opposite linear motion on the operating rod. Accordingly, a single-direction solenoid may be used to provide both push and pull functionality, thereby reducing cost and complexity, which, in turn, increases reliability.

According to an exemplary embodiment, the latching system may be used as vacuum interrupter based medium voltage capacitor switch. In such an embodiment, the operating rod may be configured to selectively couple at least two electrical contacts in response to movement between the refracted position and the extended position. The medium voltage switch may be used in utility power distribution environments, for example, in a pole-mounted or pad-mounted interrupter, operating in circuits of 15,000 Volts to 35,000 Volts and 200 amps to 400 amps.

While the exemplary embodiment may be configured as an electromechanical switch, it is contemplated that the mechanism disclosed herein may be used in any application where push and pull functionality is required, for example, as a latch or deadbolt for a door, gate, or safe.

Before discussing further details of the latching mechanism and/or the components thereof, it should be noted that references to "front," "back," "rear," "upward," "downward," "inner," "outer," "right," and "left" in this description are merely used to identify the various elements as they are oriented in the FIGURES. These terms are not meant to limit the element which they describe, as the various elements may be oriented differently in various applications.

It should further be noted that for purposes of this disclosure, the term coupled means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Referring to FIGS. 1-6, a latching mechanism 100 and components thereof are shown according to an exemplary embodiment. A base 110 is shown supporting a solenoid 120, a member (e.g., finger, bar, rod, etc.), shown as an operating rod 130, and a mechanical linkage 150. According to the embodiment shown, the base 110 is approximately 6 inches (15 cm) wide and approximately 8 inches (20 cm) tall. However, the latching mechanism 100 can easily be scaled up or down in size to suit the desired application.

Figure 7:
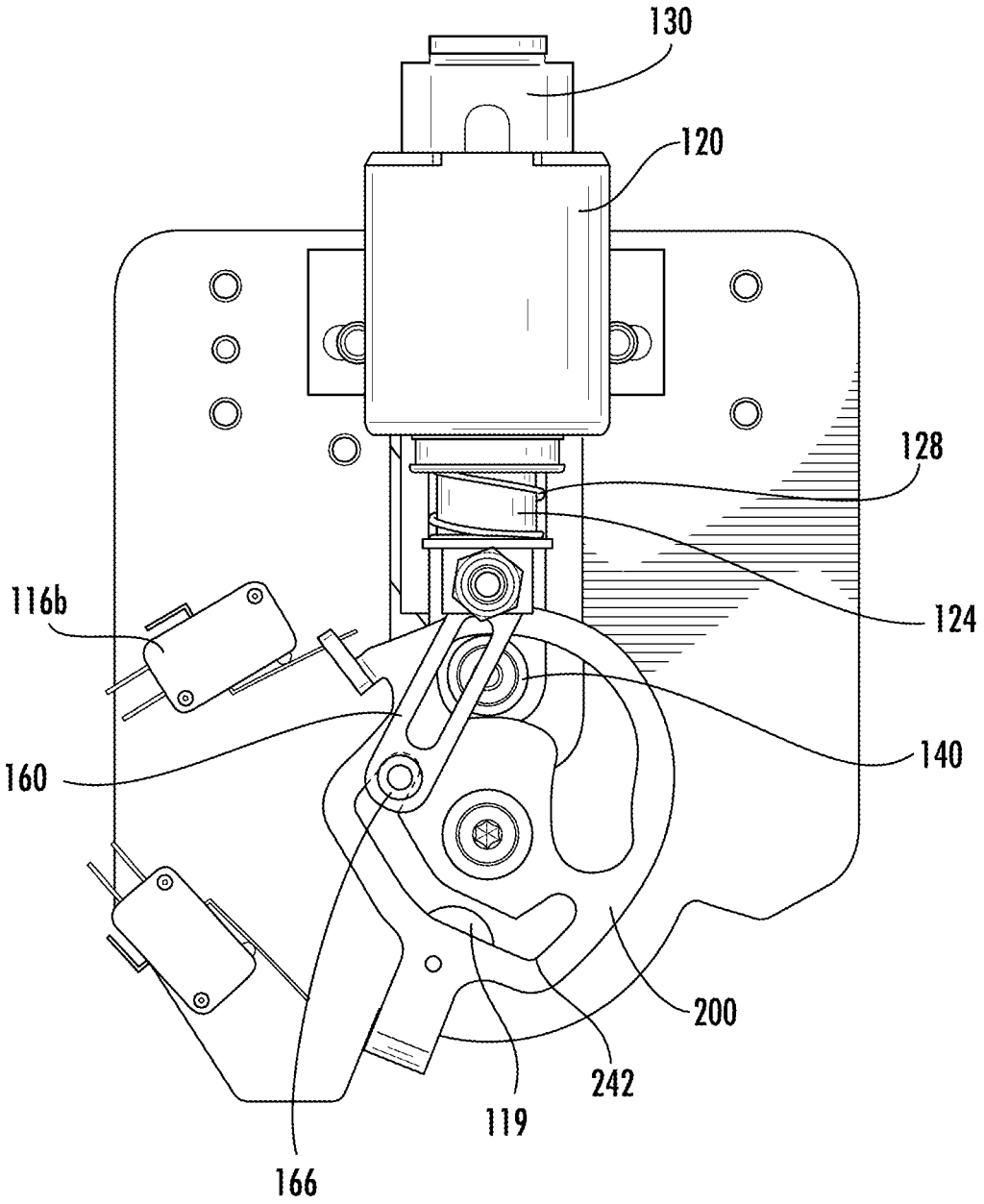
FIG. 7 is a front planar view of the latching mechanism of FIG. 1, shown in an exemplary second arrangement.

The solenoid 120 includes a housing 122 and an armature or plunger 124. The plunger 124 extends from the housing 122 to a distal end 126 and defines a longitudinal axis L. When the solenoid 120 is energized, the distal end 126 moves towards the housing 122 along the axis L to an energized position, as shown in FIGS. 7 and 9. When the solenoid 120 is de-energized, a spring 128 causes the distal end 126 to move away from the housing 122 and to return to a de-energized position, as shown in FIGS. 1-4 and 8. According to the embodiment shown, the solenoid 120 couples to base 110 with fasteners 112. Using fasteners facilitates replacement of the solenoid 120, which facilitates repair and enables the solenoid 120 to be exchanged for a solenoid having different characteristics (e.g., speed, strength, etc.). According to alternative embodiments, the solenoid 120 may be welded, adhered, or otherwise coupled to the base 110.

The operating rod 130 may be movably coupled to base 110. The operating rod 130 translates between a refracted position, as shown in FIGS. 1-4 and 9, and an extended position shown in FIGS. 7 and 8. According to the embodiment shown, the distance between the extended position and the retracted position is approximately 0.4 inches (1 cm). The length of the stroke of the operating rod 130 may be modified by changing the stroke of the solenoid 120 and/or the configuration of the mechanical linkage 150.

The operating rod 130 includes a first end 132 and a second end 134. The operating rod 130 may also include rearward extending flanges 136, which provides strength and may be configured to guide the movement of the operating rod 130 in a channel 114 defined by the base 110. The first end 132 may include a forwardly extending flange 138. According to the embodiment shown, the first end 132 is configured to indirectly push together separate electrical contacts via an extension coupled to the flange 138, but may be configured to directly connect and disconnect the contacts. The second end 134 includes a cam follower 140.

Figure 4:
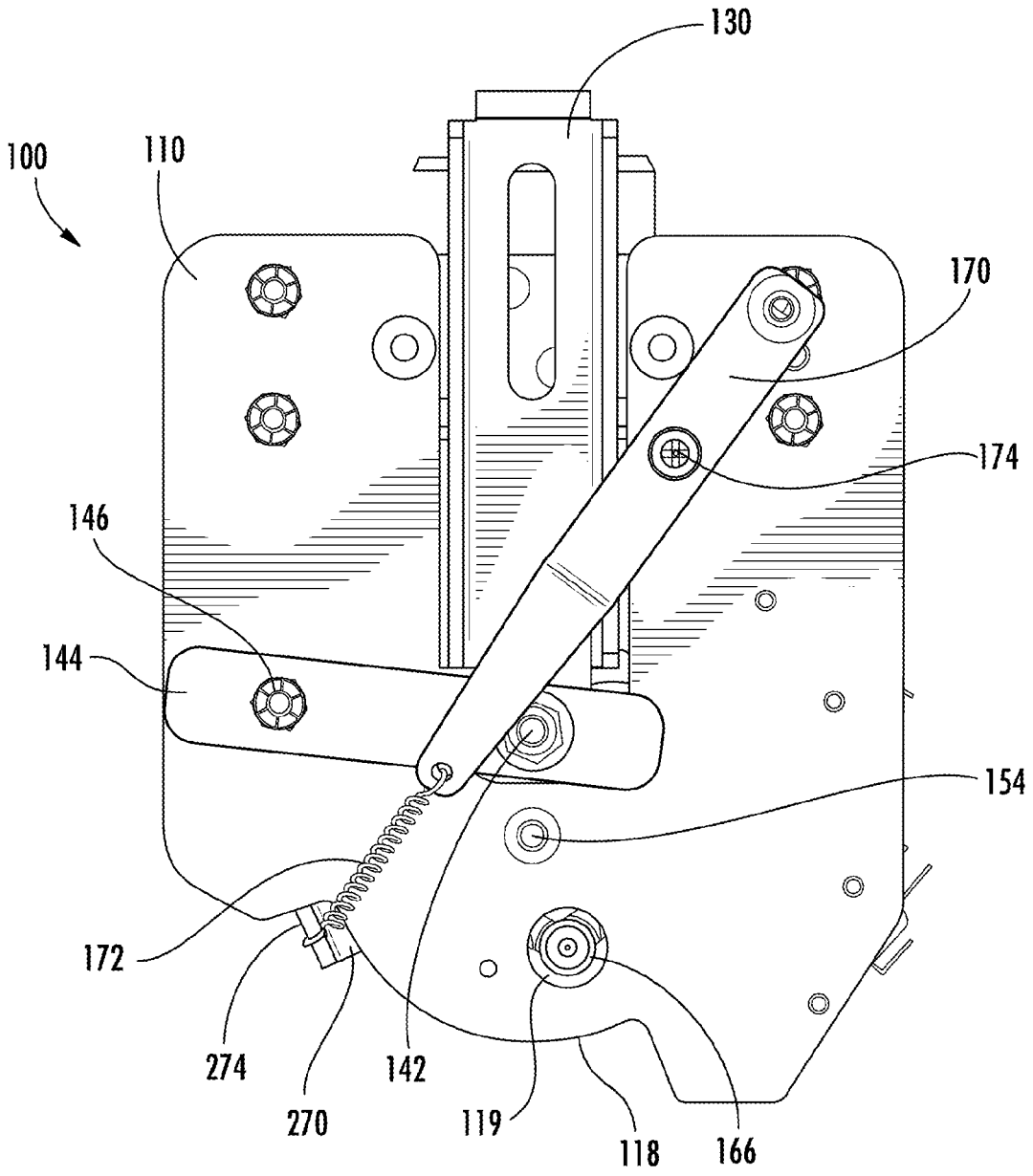
FIG. 4 is a rear planar view of the latching mechanism of FIG. 1.
Figure 5:
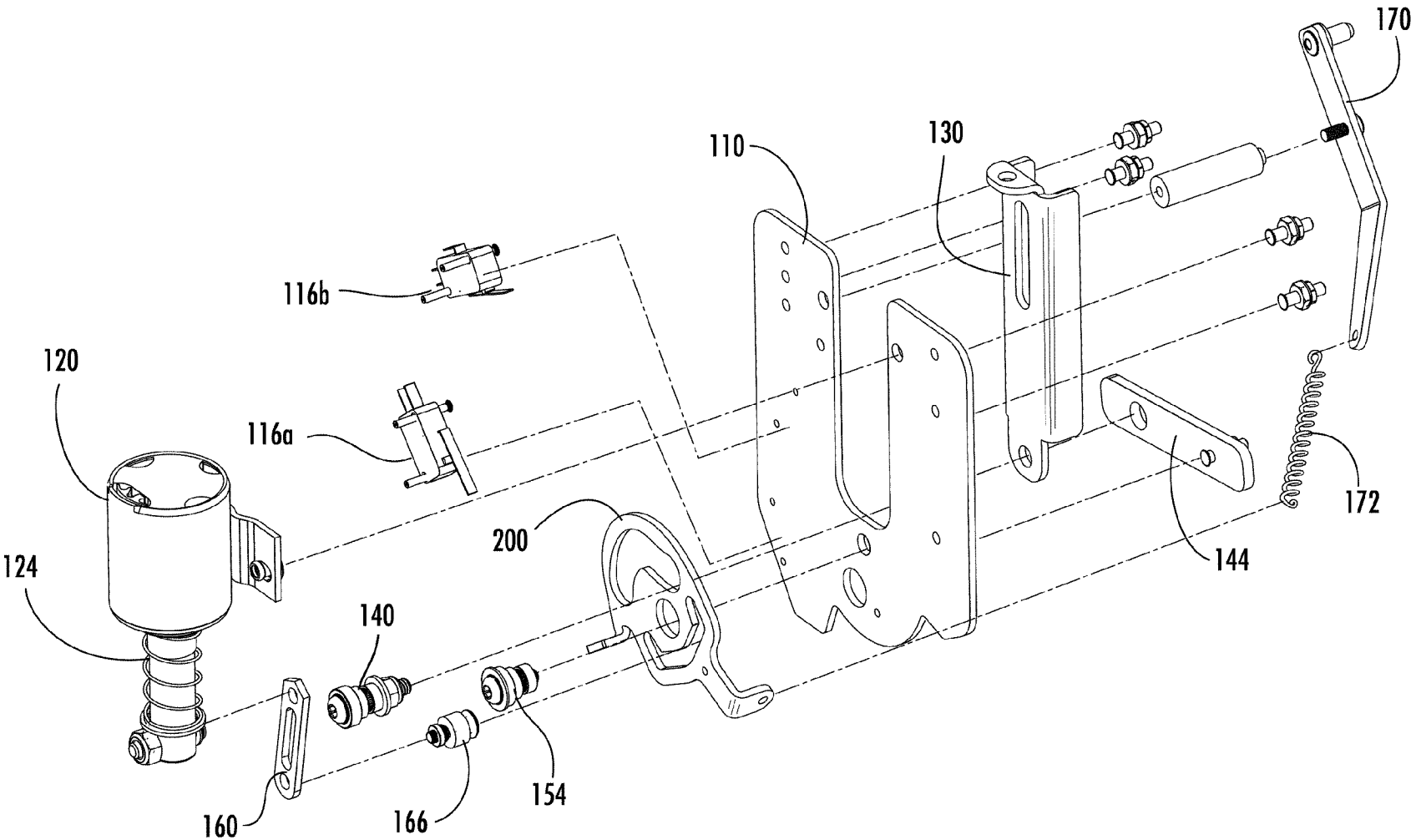
FIG. 5 is an exploded view of the latching mechanism of FIG. 1.

The cam follower 140 is shown to be supported by a fastener 142, which extends through the operating rod 130 and an arm or blade 144. Referring to FIG. 4, the blade 144 is rotatably coupled to a rear side of base 110 with a fastener 146. As blade 144 pivots about fastener 146, fastener 142 sweeps an arc to which the stroke of the operating rod 130 is substantially tangential. Further, since the stroke of the operating rod 130 is short relative to the distance from the pivot (e.g., fastener 146) to the arc (e.g., fastener 142), the arc swept by the blade 144 at the fastener 142 as it rotates about fastener 146 is approximately linear. Accordingly, the blade 144 couples the operating rod 130 to the base 110 while permitting substantially linear motion of the operating rod 130. According to alternative embodiments, the cam follower 140 may be the head of the fastener or may be integrally formed as part of the operating rod 130.

A mechanical linkage 150 is shown to include a bar (e.g., finger, member, linkage, etc.), shown as a link 160, and a structure (e.g., plate, member, rotor, etc.), shown as a cam 200. The link 160 includes a first portion 162 and a second portion 164, located opposite first portion 162. The first portion 162 is rotatably coupled to distal end 126 of plunger 124, thereby allowing the second portion 162 to depart from the axis L of the plunger 124 during the energizing and de-energizing cycles. The second portion 164 includes a cam driver 166, which may be coupled to the link 160 or integrally formed as part of the link 160. Referring to FIG. 4, the cam driver 166 may be seen through a hole 119 in the base 110 when the operating rod 130 is in a retracted position and the solenoid 120 is de-energized. Viewing cam driver 166 in this position from the rear side of base 110 enables a user (e.g., a technician) to confirm that the switch is open (i.e., powered off) before beginning repairs.

Figure 6:
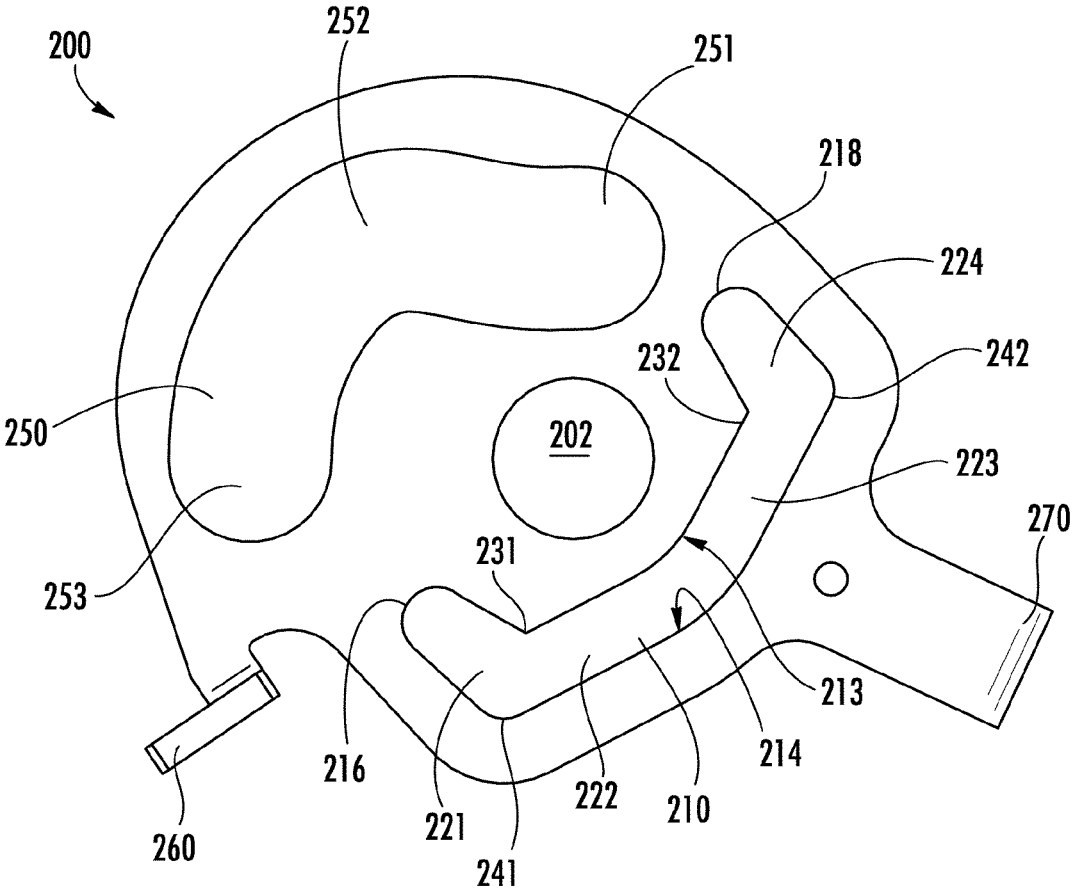
FIG. 6 is an enlarged view of a component of the latching mechanism of FIG. 1, shown according to an exemplary embodiment.

Referring to FIG. 6, the cam 200 defines a hole or aperture defined by the cam 200, shown as an opening 202, a first profile (e.g., slot, channel, groove, etc.), shown as a driving profile 210, and a second profile (e.g., slot, channel, groove, etc.), shown as an operating profile 250. A bearing 152 is located in the opening 202 and supports the cam 200 while permitting rotation of the cam 200 relative to the base 110. The cam 200 and the bearing 152 may be coupled to the base 110 by a fastener 154. The driving profile 210 is configured to receive the cam driver 166 coupled to the link 160, and the operating cam profile 250 is configured to receive the cam follower 140 coupled to the operating rod 130. Accordingly, the mechanical linkage 150 operatively couples the solenoid 120 to the operating rod 130. According to various alternative embodiments, the cam 200 may be replaced by a multi-bar linkage mechanism.

The driving profile 210 is shown to have an inner contour 213 and an outer contour 214 and to comprise a plurality of segments, shown as a first segment 221, a second segment 222, a third segment 223, and a fourth segment 224. The first segment 221 extends at an angle from the second segment 222 to a first end 216. The first segment 221 and the second segment 222 form an outwardly convex first corner 231 of the inner contour 213 and form an inwardly concave first corner 241 of the outer contour 214. The second segment 222 and the third segment 223 are substantially continuous and follow a somewhat circumferential path around opening 202. The fourth segment 224 extends at an angle from the third segment 223 to a second end 218. The fourth segment 224 and the third segment 223 form an outwardly convex second corner 232 of the inner contour 213 and form an inwardly concave second corner 242 of the outer contour 214.

The distance from the first corner 241 to the second corner 242 of the outer contour 214 is greater than the distance from the first corner 231 to the second corner 232 of inner contour 213. The first corner 231 of the inner contour 213 is closer to the longitudinal axis L of the plunger 124 than is the first corner 241 of the outer corner 214. Similarly, the second corner 232 of the inner contour 213 is closer to the longitudinal axis L of the plunger 124 than is the second corner 242 of the outer corner 214. Accordingly, when the solenoid 120 is in a de-energized state and the cam driver 166 rests in either the first corner 241 or the second corner 242 of the outer contour 214, the cam driver 166 is biased to enter the first segment 221 or the fourth segment 224, respectively, when solenoid 120 is energized. According to alternative embodiments, the driving profile 210 may comprise other shapes, e.g., a substantially V-shaped opening having a wide base such the cam driver 166 is biased to one side or the other of the fork in the V when the solenoid 120 is de-energized.

The operating profile 250 is shown to include a first portion, shown as a retracted portion 251, and a second portion, shown as a transition portion 252, and a third portion, shown as an extend portion 253. The retracted portion 251 includes a radially outward turned end which prevents cam 200 from rotating in response to force applied to operating rod 130, thereby retaining operating rod 130 in a retracted position. The transition portion 252 extends between the retracted portion 251 and the extended portion 253 and is configured to cause the operating rod 130 to move between a retracted position and an extended position in response to rotation of the cam 200 about the bearing 152. The extended portion 253 is configured to retain the operating rod 130 in an extended position. For example, the extended portion 253 includes a constant radius about the opening 202 which prevents rotation of the cam 200 in response to force applied to the operating rod 130 and prevents retraction of the operating rod 130 in response to minor rotation of the cam 200. Accordingly, the operating rod 130 may be mechanically latched at either the extended position or the retracted position. The operating profile 250 may also be configured to provide torque multiplication. According to the exemplary embodiment, the solenoid 120 provides 30 pounds (133 newtons) of force, whereas operating rod 130 provides over 100 pounds (445 newtons) of force to the electrical contacts.

Figure 2:
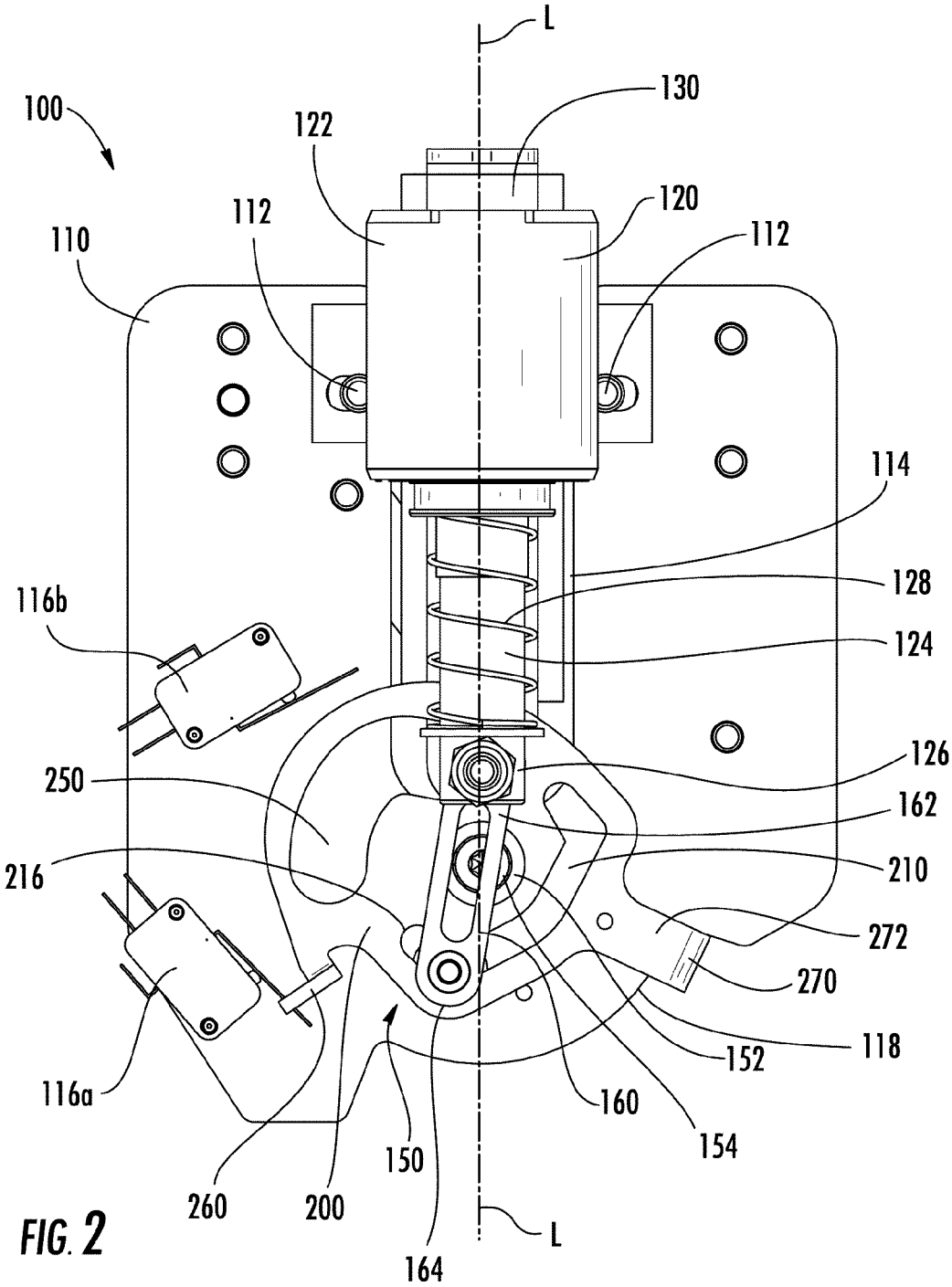
FIG. 2 is a front planar view of the latching mechanism of FIG. 1.
Figure 3:
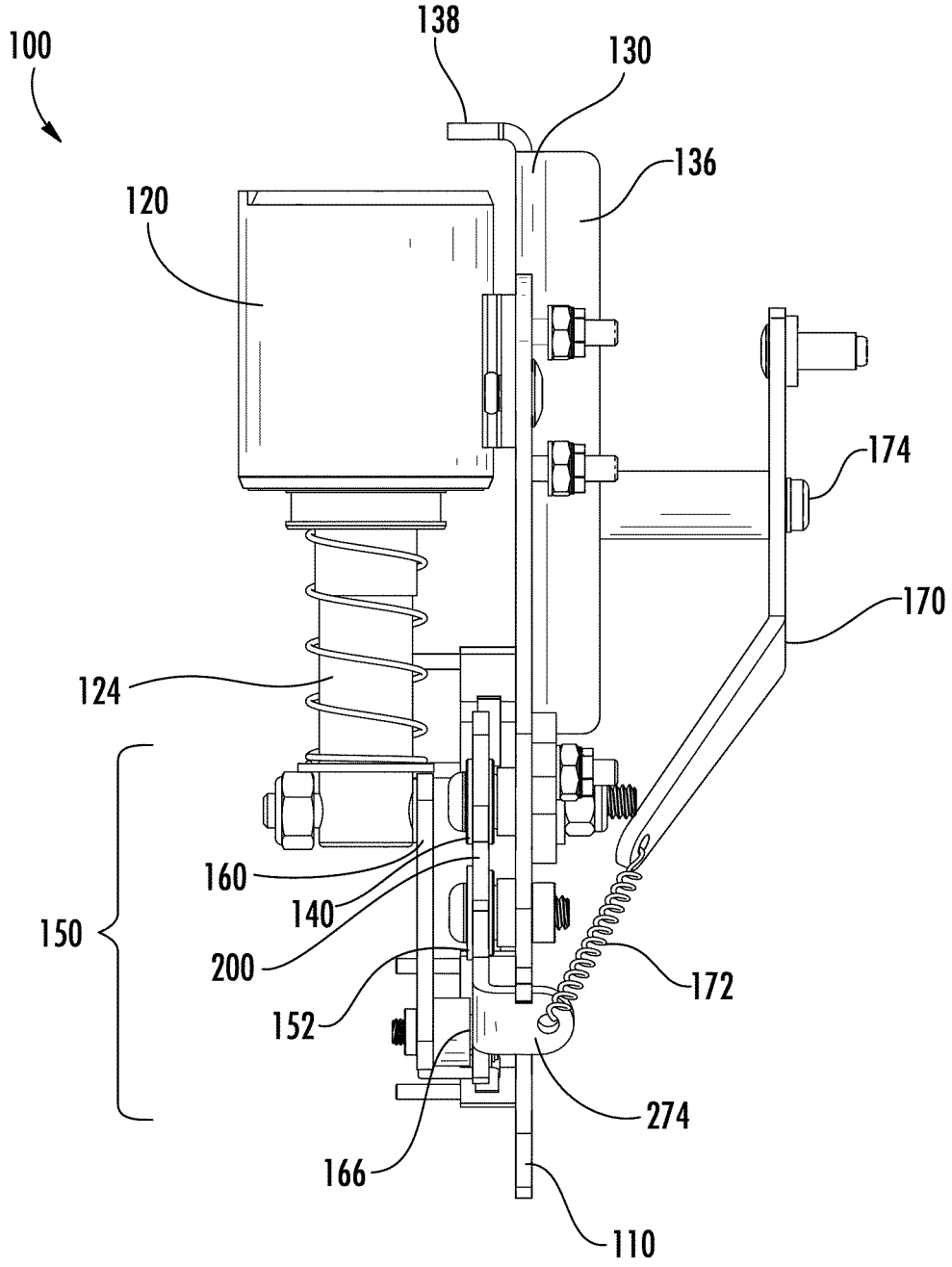
FIG. 3 is a right side planar view of the latching mechanism of FIG. 1.

Referring to FIGS. 3-4, the cam 200 may include a flange 270, which includes a radially outward extending portion 272 and a rearward extending portion 274. The rearward extending portion 274 extends from a front side or cam side of the base 110 to a back side or handle side of the base 110. On the back side of the base 110, the flange 270 is coupled to a lever or handle 170 by a spring 172, the handle 170 being rotatably coupled to the base 110 by a fastener 174. As the cam 200 rotates between a first or retracted orientation (shown in FIGS. 2 and 9) and a second or extended orientation (shown in FIGS. 7-8), the rearward extending portion 274 of the flange 270 concentrically follows a curved edge 118 of base 110. In turn, the handle 170 rotates between a first or retracted position and a second or extended position as it is pulled by the spring 172. The handle 170 may be used for manual override of the cam 200. That is, the cam 200 will rotate between the extended and retracted orientations in response to movements of the handle 170 between the extended and retracted positions, respectively. According to alternative embodiments, the handle 170 may be located forward of the base 110, or the flange 270 may be configured to be a handle, e.g., extend outward so as to provide a gripping surface for a user.

The lever mechanism of handle 170 may further be configured to retain the cam 200 in extended or retracted orientations. The flange 270 sweeps a substantially circular arc around the curved edge 118 as the cam 200 rotates, the curved edge 118 of base 110 following an arc of substantially constant radius around the fastener 154. As shown, the axis of rotation of the handle 170 (e.g., the fastener 174) is diametrically opposite the axis of rotation of the cam 200 (e.g., the fastener 154) from the midpoint of the arc of the curved edge 118. Accordingly, the distance from the handle 170 to the rearward extending portion of the flange 270 is greater when the cam 200 is between the extended and retracted orientations than when the cam 200 is in one of the extended orientation and retracted orientation. As such, when the cam 200 rotates from the retracted orientation to the extended orientation, the spring 172 stretches, and the tensile forces in the spring increase, until the apex of the curved path of the flange 270 is reached. As the cam 200 continues to rotate passed the apex of the curve, the spring 172 decreases in length until the extended orientation is reached. Rotating the cam 200 back to the retracted orientation would require again stretching the spring 172. Accordingly, the spring 172 retains the cam 200, and therefore the operating rod 130, in an extended or retracted position, and when the cam 200 and the handle 170 rotate past the apex of the curve, the spring 172 pulls the cam 200 and the handle 170 to the end position or orientation. According to alternate embodiments, the axis of rotation (e.g., the fastener 174) or the handle 170 may be located so that the point of maximum stretch of the spring 172 is not at mid-rotation of cam 200. Accordingly, the tensile force of the spring 172 may be configured to correspond to (e.g., assist) the forces generated by the operating profile 250 on the cam follower 154.

The latching mechanism 100 may include one or more position sensors configured to determine the position or orientation of the cam 200. According to the embodiment shown, the latching mechanism 100 includes first and second switches, shown as a retracted switch **116*a* and an extended switch 116*b*, coupled to the base 110. The refracted switch 116*a* is configured to output a signal in response to the cam 200 being in the retracted orientation. For example, the cam 200 may include a radially outward extending flange 260, and the retracted switch 116*a* may open or close a circuit when the flange 260 contacts the retracted switch 116*a*. Similarly, the extended switch 116*b* may output a signal in response to the cam 200 being in the extended orientation, in which case the flange 260 contacts the extended switch 116*b***.

According to an exemplary embodiment, the switches **116*a* and 116*b* may be coupled to the power circuit for the solenoid 120. Accordingly, the circuit may be configured such that the solenoid 120 is de-energized when it reaches the extended or retracted position. That is, when the flange 260 contacts the switch 116*a* or 116*b* respectively, power to the solenoid 120 is switched off. This prevents the solenoid 120 from attempting to push or pull the operating rod 130 too far, thereby reducing burnout of the solenoid and extending the life of the solenoid. The position sensors also enable remote monitoring and diagnostics of the mechanical latch 110. According to alternative embodiments, the sensor may be a Hall effect sensor or a rotational position senor coupled to the rotational axis of the cam 200, e.g., if the fastener 154 were fixedly coupled to the cam 200. Alternatively again, the sensor may output a signal in response to the position of the operating rod 130, the handle 170, or the solenoid plunger 124**.

While many components of the latching mechanism 100 are shown disposed on the base 110, it is contemplated that the components may be supported by one or more other structures. Each of the fasteners described may be the same or different type and/or size. Further, it is contemplated that any fastener may be replaced by a stud, boss, pin or other suitable coupling mechanism.

Figure 8:
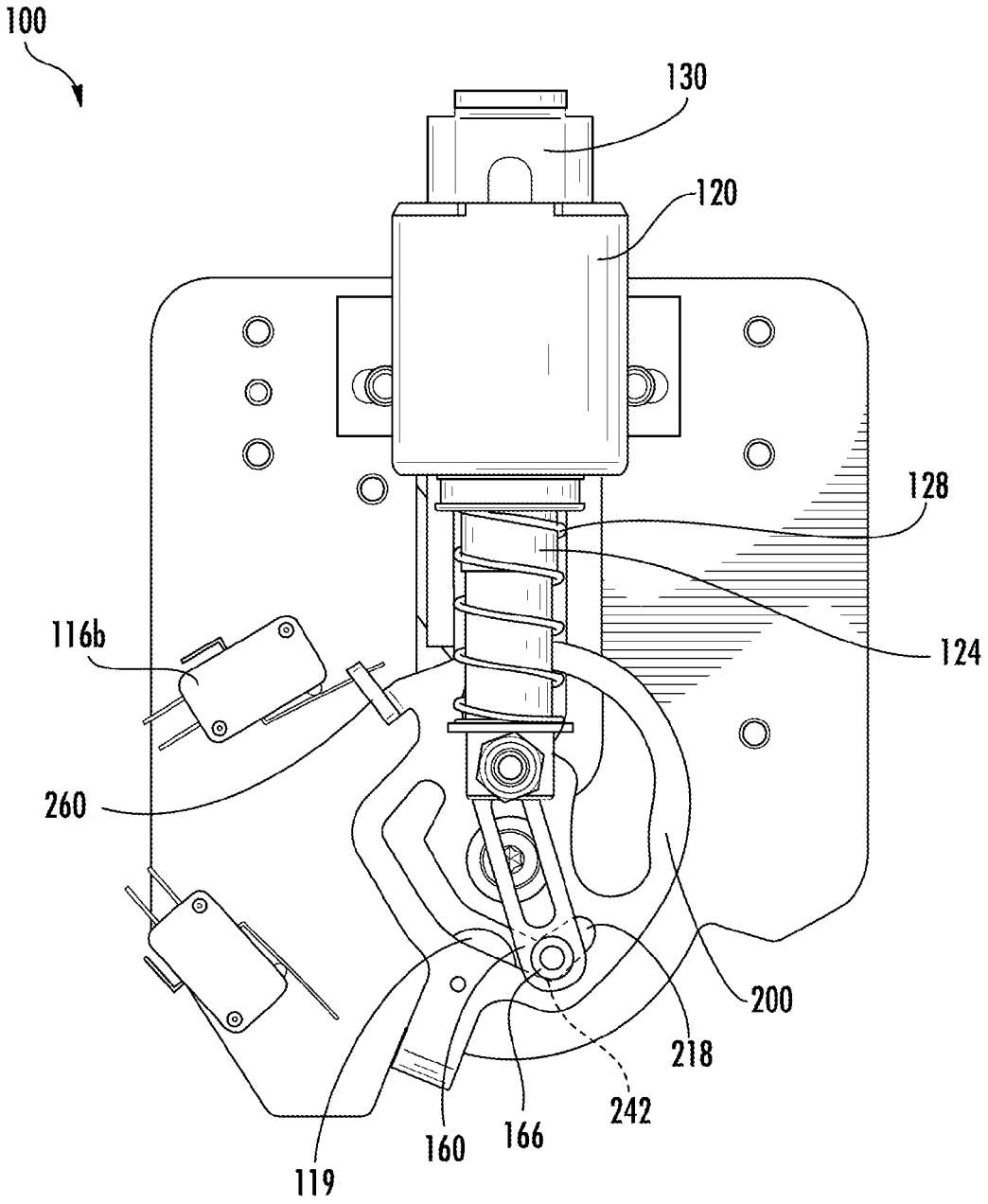
FIG. 8 is a front planar view of the latching mechanism of FIG. 1, shown in an exemplary third arrangement.
Figure 9:
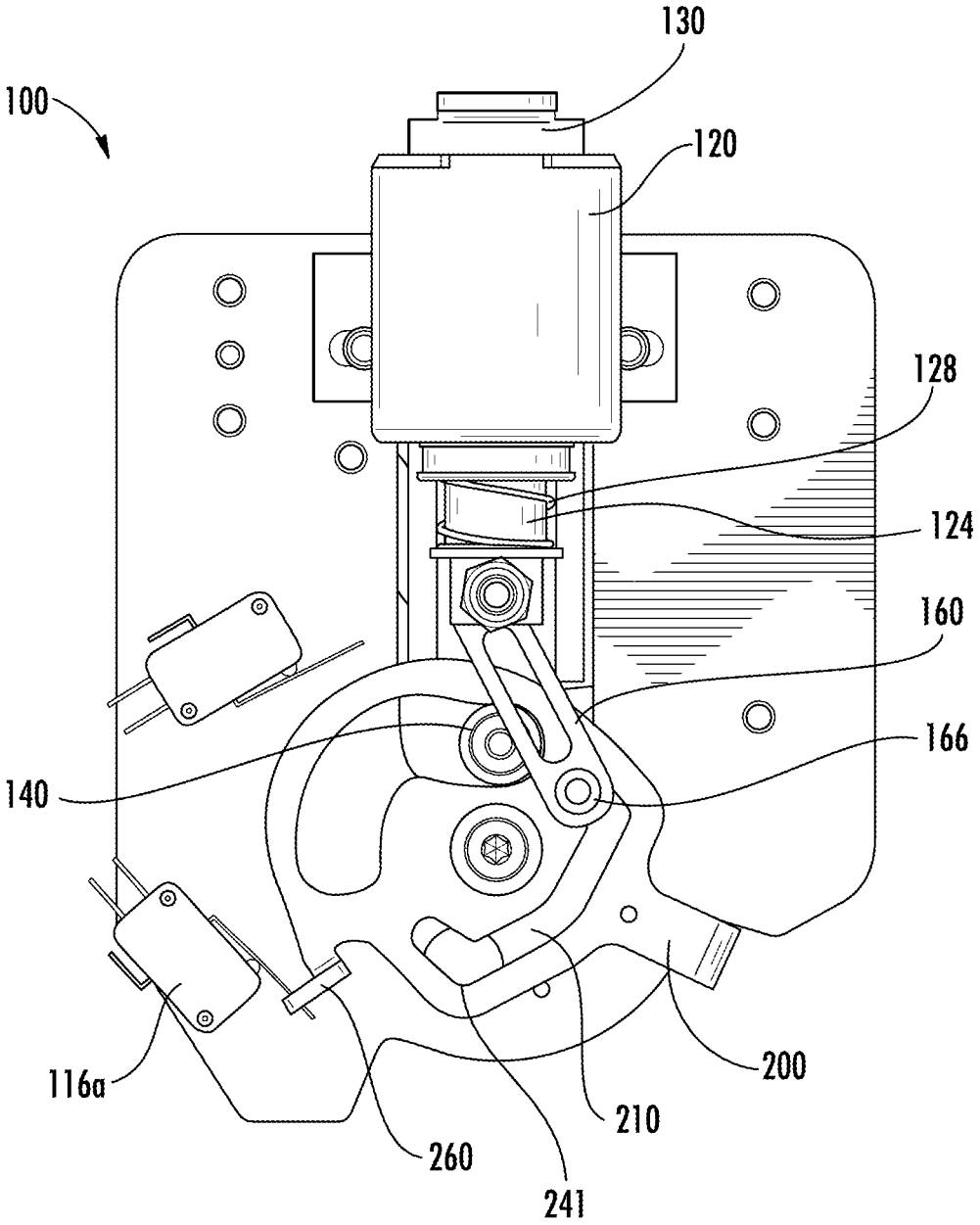
FIG. 9 is a front planar view of the latching mechanism of FIG. 1, shown in an exemplary fourth arrangement.

Referring now to FIGS. 2 and 7-9, the operation of the latching mechanism 100 is described according to an exemplary embodiment. FIG. 2 depicts the solenoid 120 in a de-energized position and the cam 200 in a retracted orientation; FIG. 7 depicts the solenoid 120 in an energized position and the cam 200 in an extended orientation; FIG. 8 depicts the solenoid 120 in a de-energized position and the cam 200 in a retracted orientation; and FIG. 9 depicts the solenoid 120 in an energized position and the cam 200 in an extended orientation According to an exemplary embodiment, transition from FIG. 2 to FIG. 7 comprises a first energized state of the solenoid 120; transition from FIG. 7 to FIG. 8 comprises a first de-energized state; transition from FIG. 8 to FIG. 9 comprises a second energized state of solenoid 120; and transition from FIG. 9 to FIG. 2 comprises a second de-energized state. A first cycle may comprise the first energized state and the first de-energized state. A second cycle may comprise the second energized state and the second de-energized state. As described below, the latch mechanism 100 is configured such that the first and second cycles alternate, and alternating energized states of the solenoid 120 cause opposite linear motion of operating rod 130.

Beginning with FIG. 2, and with reference to FIG. 6, the operating rod 130 is shown in a retracted position, and the cam driver 166 is shown resting in the first corner 241 of the outer contour 214 of the driving profile 210 of the cam 200. In this position, the cam driver 166 may be viewed through the hole 119 in the base 110 from the rear side of the base 110 (See FIG. 4). As the solenoid 120 is energized (e.g., is in the first energized state), the plunger 124 retracts upward, which pulls the link 160 upward. Since the first corner 241 of the outer contour 214 is biased outwards of the first corner 231 of the inner contour 213, the cam driver 166 follows the inner contour 213 into the first segment 221 of the driving profile 210 until it reaches the first end 216. As the plunger 124 continues to retract, the cam driver 166 pulls on the first end 216 of the driving profile 210, thereby causing rotation of the cam 200 about the bearing 152. As the cam 200 rotates, the operating profile 250 acts upon the cam follower 140. The cam follower 140 leaves the retracted portion 251, passes through the transition portion 252, and enters the extended portion 253. As the cam follower 140 passes through the transition portion 252, the cam follower 140 is forced upwards, which in turn moves the operating rod 130 from the retracted position to the extended position. According to the embodiment shown, the cam 200 rotates approximately 87 degrees between the retracted orientation and the extended orientation.

At this point, the latching mechanism 100 is arranged as in FIG. 7, with the operating rod 130 in the extended position. The flange 260 of the cam 200 contacts the switch **116*b* and closes the power circuit to the solenoid 120. As the solenoid 120 de-energizes (e.g., is in the first de-energized state), the spring 128 forces the plunger 124 downward, which pushes the link 160 downward. The cam driver 166 follows the driving profile 210 until coming to rest in the second corner 242 of the outer contour 214. At which point, the first cycle is complete, with the latching mechanism 100 arranged as shown in FIG. 8, and the operating rod 130 mechanically latched into the extended position by the cam 200. In this position, the cam driver 166 is offset from the hole 119 and, therefore, may not be viewable through the hole 119 in the base 110 from the rear side of the base 110. Accordingly, a user would be alerted that the operating rod 130** may be in an extended position.

When solenoid 120 is next energized (e.g., in the second energized state), the plunger 124 is drawn upward, but because the second corner 241 of the outer contour 214 is biased outwards of the second corner 232 of the inner contour 213, the cam driver 166 follows the inner contour 213 towards the second end 218 of the driving profile 210. As the plunger 124 continues to draw upward, the cam driver 166 pulls on the second end 218, causing the cam 200 to rotate oppositely to the direction it rotated during the first energized state. As the cam 200 rotates, the cam follower 140 leaves the extended portion 253 of the operating profile 250, passes through the transition portion 252, and enters the retracted portion 251. As the cam follower 140 passes through the transition portion 252, the cam follower 140 is forced downwards, which causes the operating rod 130 to move from the extended position to the refracted position.

At this point, the latching mechanism 100 arranged as in FIG. 9, with the operating rod 130 in the retracted position. The flange 260 of the cam 200 contacts the switch **116*a*, which closes the power circuit to the solenoid 120. As the solenoid 120 de-energizes (e.g., is in the second de-energized state), the spring 128 forces the plunger 124 downward, which pushes the link 160 downward. The cam driver 166 follows the driving profile 210 until coming to rest in the first corner 241 of the outer contour 214. At which point, the second cycle is complete, with the latching mechanism 100 arranged as shown in FIG. 2, and the operating rod 130 mechanically latched into the extended position by the cam 200. When the solenoid 120 is next energized, the latching mechanism 100** will respond as described for the first cycle.

The cam 200 and the solenoid 120 may be configured to control the velocity of operating rod 130. According to an exemplary embodiment in which the latch mechanism 100 is used in a voltage capacitor switch, the operating rod 130 should generate 70% of its total contact force between the electrical contacts within a half-loop of alternating current (e.g., at 60 hertz, approximately 8.3 milliseconds), so that the electrical contacts can couple at less than maximum current, thereby reducing arcing between the contacts. At the same time, the velocity of the operating rod 130 should be limited so as not to cause premature wear and failure of the bellows used in a vacuum interrupter application. Further, excessive velocity may cause the electrical contacts to bounce or rebound off of one another, thereby causing arcing, which reduces the life of the equipment.

It is also important to note that the construction and arrangement of the elements of the latching mechanism as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the enclosure may be constructed from any of a wide variety of materials that provide sufficient strength or durability, in any of a wide variety of colors, textures, and combinations. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present inventions. Other substitutions, modifications, changes, and omissions may be made in the design, operating conditions, and arrangement of the preferred and other exemplary embodiments without departing from the spirit of the appended claims.

The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the spirit of the appended claims.

What is claimed is:

1. A switch for an electrical circuit, comprising:

a base;

a cam rotatably coupled to the base and defining a first profile and a second profile, the first profile including a first position, a second position, a third position, and a fourth position;

a solenoid comprising alternating first and second cycles, the first cycle including a first energized state and a first de-energized state and the second cycle including a second energized state and a second de-energized state;

a link including a first portion and a second portion, the first portion coupled to the solenoid, the second portion movably coupled to the first profile of the cam; and a member configured to move in a linear direction between an extended position and a retracted position and comprising a cam follower configured to follow the second profile;

wherein when the solenoid is in the first cycle, the member moves from the retracted position to the extended position, and wherein when the solenoid is in the second cycle, the member moves from the extend position to the retracted position.

2. The switch of claim 1, wherein when the solenoid is in the first energized state, the second end of the link moves from the first position to the second position and the member moves from the retracted position to the extended position;

wherein when the solenoid is in the first de-energized state, the second end of the link moves from the second position to the third position and the member remains in the extended position;

wherein when the solenoid is in the second energized state, the second end of the link moves from the third position to the fourth position and the member moves from the extended position to the retracted position; and wherein when the solenoid is in the second de-energized state, the second end of the link moves from the fourth position to the first position and the member remains in the retracted position.

3. The switch of claim 1, wherein the member comprises a first end and a second end, the first end proximate the cam follower and the second end configured to selectively couple at least two electrical contacts in response to movement between the retracted position and the extended position.

4. The switch of claim 1, wherein the second profile is configured retain the member in the extended state when the solenoid is in the first de-energized state, and wherein the second profile is configured retain the member in the retracted state when the solenoid is in the second de-energized state.

5. The switch of claim 4, wherein the second profile comprises a portion having a constant radius.

6. The switch of claim 1 further comprising at least one position sensor configured to detect the orientation of the cam.

7. The switch of claim 1 further comprising a handle configured to rotate the cam when the solenoid is de-energized.

8. The switch of claim 7 further comprising a spring coupling the handle to the cam.

9. The switch of claim 8, wherein the distance from the handle to the cam is greater when the member is between the extended position and the retracted position than when the member is in one of the extended position and the retracted position.

10. The switch of claim 1, wherein said second portion of said link is coupled to said cam to follow the first profile of the cam.

11. A switch for an electrical circuit, comprising:

a solenoid comprising alternating energized and de-energized states;

a cam defining a first profile and a second profile;

a link including a first portion and a second portion, the first portion coupled to the solenoid, the second portion movably coupled to the cam to follow the first profile; and a member configured to move in a linear direction between an extended position and a retracted position and comprising a cam follower configured to follow the second profile;

wherein the cam is configured such that alternating energized states of the solenoid cause opposite linear motion of the member.

12. The switch of claim 11, wherein the cam moves from a first orientation to a second orientation, the member moves from a retracted position to an extended position, and wherein when the cam moves from the second orientation to the first orientation, the member moves from the extended position to the retracted position.

13. The switch of claim 11, wherein the solenoid comprises an armature movable along a longitudinal axis; and wherein the first profile comprises:

an outer contour having an inwardly concave first corner configured to receive the second portion of the link when the solenoid is in a de-energized state and the cam is in a first orientation; and an inner contour having an outwardly convex first corner, the first corner of the inner contour being closer to the longitudinal axis of the solenoid than the first corner of the outer contour.

14. The switch of claim 13, wherein outer contour of the first profile comprises a second inwardly concave corner configured to receive the second portion of the link when the solenoid is in a de-energized state and the cam is in a second orientation; and wherein the inner contour of the first profile comprises a second outwardly convex corner, the second corner of the inner contour being closer to the longitudinal axis of the solenoid than the second corner of the outer contour.

15. The switch of claim 14, wherein the first profile comprises a first end located opposite the first corner of the inner contour from the longitudinal axis and a second end located opposite the second corner of the inner contour from the longitudinal axis; and wherein when the solenoid is in a first energized state, the second portion of the link moves from the first corner of the outer contour to the first end, causing rotation of the cam from a first orientation to a second orientation, and wherein when the solenoid is in a second energized state, the second portion of the link moves from the second corner of the outer contour to the second end, causing rotation of the cam from the second orientation to the first orientation.

16. A latching system, comprising:

a solenoid comprising a first energized state, a first de-energized state, a second energized state and a second de-energized state;

a member configured to translate in a linear direction between an extended position and a retracted position; and a mechanical linkage operatively coupling the solenoid to the member, the mechanical linkage having a first orientation and a second orientation;

wherein the mechanical linkage is configured such that when the solenoid is in the first energized state, the member moves from the retracted position to the extended position and the mechanical linkage moves from the first orientation to the second orientation, and wherein the mechanical linkage is configured such that when the solenoid is in the second energized state, the member moves from the extended position to the retracted position and the mechanical linkage moves from the second orientation to the first orientation.

17. The latch of claim 16, wherein the first energized state and the second energized state alternate in time.

18. The latch of claim 16, wherein the solenoid comprises a first de-energized state occurring between the first energized state and the second energized state and a second de-energized state occurring after the second energized state; and wherein the mechanical linkage is configured such that the member remains in the extended position when the solenoid is in the first de-energized state, and the member remains in the retracted position when the solenoid is in the second de-energized state.

19. The latch of claim 16, wherein the mechanical linkage comprises a cam configured to control the velocity of the member.

20. The latch of claim 16, wherein the mechanical linkage comprises a cam configured to control the force of the member.

21. A switch comprising:

an operating rod configured to translate in a linear direction between a first position and a second position; and a solenoid actuator and a link for moving the operating rod from the first position to the second position and from the second position to the first position, wherein the solenoid actuator includes only one solenoid for causing travel in each direction between the first position and the second position and does not require electronic controls to maintain current at the first position and the second position.

* * * * *